United States Patent [19]

Fielding et al.

[11] 4,020,903

[45] May 3, 1977

[54] FIRE-FIGHTING FOAM COMPOSITIONS

[75] Inventors: Harold Crosbie Fielding; John Hutchinson; Samuel John Webster, all of Runcorn, England

[73] Assignee: Imperial Chemical Industries Limited, London, England

[22] Filed: Mar. 15, 1976

[21] Appl. No.: 667,013

Related U.S. Application Data

[63] Continuation of Ser. No. 195,507, Nov. 3, 1971, abandoned, which is a continuation of Ser. No. 818,081, April 21, 1969, abandoned.

[30] Foreign Application Priority Data

| | | |
|---|---|---|
| Apr. 29, 1968 | United Kingdom | 20214/68 |
| May 7, 1968 | United Kingdom | 21613/68 |
| Sept. 27, 1968 | United Kingdom | 46013/68 |
| Oct. 25, 1968 | United Kingdom | 50787/68 |

[52] U.S. Cl. ..... 169/47; 252/3

[51] Int. Cl.[2] ..... A62B 1/12

[58] Field of Search ..... 169/47; 252/3, 8.05

[56] References Cited

UNITED STATES PATENTS

| | | | |
|---|---|---|---|
| 3,258,423 | 6/1966 | Tuve et al. | 252/3 |
| 3,475,333 | 10/1969 | Meldrum et al. | 252/3 |
| 3,519,682 | 7/1970 | Fielding | 260/513 |
| 3,630,951 | 12/1971 | Netherly | 252/307 |
| 3,632,641 | 1/1972 | Fielding | 260/539 R |
| 3,661,776 | 5/1972 | Fletcher et al. | 252/3 |

*Primary Examiner*—Leland A. Sebastian
*Attorney, Agent, or Firm*—Cushman, Darby & Cushman

[57] ABSTRACT

A method of fighting fires which comprises applying to the fire a foam produced from an aqueous composition comprising as a surface-active agent the residue of a branched oligomer of tetrafluoroethylene $(C_2F_4)_n$ wherein n is 4, 5, or 6 having a hydrophilic group attached to the residue of the oligomer, said oligomer having at least three $CF_3$ groups and being characterized by a formula selected from the group consisting of:

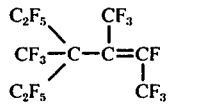

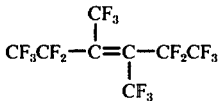

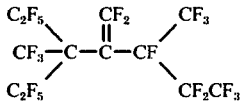

and

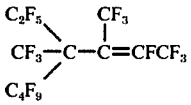

The surfactants are particularly effective when incorporated in foams derived from other foam-producing materials.

2 Claims, No Drawings

FIRE-FIGHTING FOAM COMPOSITIONS

This is a continuation of application Ser. No. 195,507 filed Nov. 3, 1971, now abandoned, which is a continuation of Ser. No. 818,081, filed Apr. 21, 1969 now abandoned.

This invention relates to novel compositions for making aqueous foams suitable for applying to burning materials, especially to burning liquids for example hydrocarbon fuels, in order to extinguish flames and prevent reignition.

It is known to use aqueous foams in fire-fighting, either alone or together with finely-divided dry fire-extinguishing chemicals, for example sodium and potassium bicarbonates. The latter extinguish flames when dispersed into the combustion zone but reignition is always possible as long as an exposed surface of fuel remains. To prevent this it is useful to smother the surface with a foam, which if it is continuous and stable under the local prevailing conditions can much reduce the chance of reignition occurring.

Among known foams for this purpose are those based on materials derived from proteins and often described as protein foams. They are not ineffective and are relatively cheap, but require to be spread in thick, heavy layers that are easily ruptured. Since protein foams do not flow readily they have no self-healing properties hence rupture of the foam layer exposes fresh areas of fuel liable to reignite. Protein foams are often rendered unstable and made to collapse by some of the finely-divided chemical powders used to extinguish the flames, particularly when these chemicals have been treated with certain free-flowing or anti-caking agents for example silicones.

Also known for fire-fighting are foams based on surface-acting agents containing perfluoroalkyl groups in the molecule. Such foams are stable in the presence of silicone-coated powdered materials, for example sodium and potassium bicarbonates, they spread readily and quickly re-form after rupture.

We have now discovered that certain fluorine-containing surface-active agents derived from tetrafluoroethylene oligomers can in aqueous solutions be readily foamed to give foams having good stability, good compatibility with finely-divided fire-extinguishing chemicals such as sodium bicarbonate, high resistance to attack by flame or by burning fuels, and good flow properties over the surface of hydrocarbon fuels.

We have also found that some surface-active agents derived from branched tetrafluoroethylene oligomers and containing branched perfluoro groups are particularly effective when incorporated in foams derived from other foam-producing materials.

The foams are thereby rendered more mobile giving them greater sealing and re-sealing properties and making them able to spread more quickly over a surface, whilst preserving or even increasing their thermal stability and increasing their resistance to burning when in contact with hydrocarbon fuels and fires involving water-miscible solvents such as alcohols. The foams are also rendered more stable to contact with dry chemical powder extinguishers. A further advantage of the addition of the surface active agents derived from oligomers is that they impart to foams increased tolerance to fuels especially to petrol.

Thus according to the present invention there is provided a method of producing a fire-extinguishing foam which comprises foaming an aqueous composition comprising a surface-active agent derived from a branched oligomer of tetrafluoroethylene $(C_2F_4)_n$ wherein $n$ is an integer equal at least to 4.

There is further provided a composition comprising at least one surface-active agent derived from a branched oligomer of tetrafluoroethylene wherein n is an integer equal at least to 4 and at least one further agent, not derived from a branched oligomer of tetrafluoroethylene, for producing a fire-fighting foam.

As a further aspect of the invention there is provided a method of fighting a fire which comprises applying to the fire a foam produced from an aqueous composition comprising a surface-active agent derived from a branched oligomer of tetrafluoroethylene $(C_2F_4)_n$ wherein $n$ is an integer equal at least to 4.

The branched oligomers of tetrafluoroethylene may be produced for example by the process described in British Pat. No. 1,082,127. A variety of different structures may be produced but in general terms all the oligomers are highly-branched perfluoroolefins. For example, the fluorocarbon group in $C_{10}F_{19}O.C_6H_5$, from which the pentomer oxybenzene surface-active agents are derived, appears to have the following structure

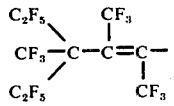

Similarly, the fluorocarbon group in $C_8F_{15}O.C_6H_5$, is derived from tetramer having the following structure

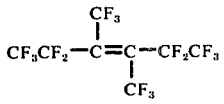

In the case of hexamer derivatives, the structures are based on a number of mixed isomers of hexamer. Evidence for the structure of two of the isomers for hexamer is consistent with the following structures

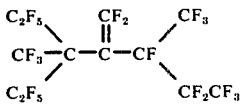

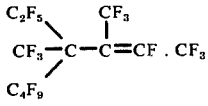

The surface-active agents of this invention are derived from the tetrafluoroethylene oligomers by a variety of chemical reactions, all designed to attach suitable hydrophilic groups to the carbon skeleton of the oligomer. In certain reactions, for example those described in U.K. Specification Nos. 1,130,822 and 1,148,486, nucleophiles containing reactive hydrogen atoms or other reactive atoms abstract fluorine from the oligomer molecule and make a covalent link between the oligomer and the nucleophile. In U.K. Pats. Nos. 1,155,607 and 1,176,492 (corresponding with U.S. Pats. Nos. 3,519,682 and 3,362,641, respectively), reactions are described wherein the oligomer structure is modified; the nucleophilic attack removes some carbon and fluorine atoms and the resulting oligomer residue, besides being smaller, is observed to contain one or more hydrogen atoms attached to the remaining carbon atoms.

The surface-active agents of this invention are among those described in the above applications or are related to or derived from the products described therein and may contain anionic, cationic, amphoteric or neutral hydrophilic groups. For example the surface active agent $C_{10}F_{19}OC_6H_4SO_3Na$, which can be described as tetrafluoroethylene pentameroxybenzene sodium sulphonate, can be made by a reaction between pentamer $(C_2F_4)_5$ and $NaOC_6H_4SO^-_3$ $Na^+$, to give the product and sodium fluoride; it can also be made by reacting pentamer and phenol in the presence of a base to give $C_{10}F_{19}OC_6H_5$, sulphonating the latter with oleum to give $C_{10}F_{19}OC_6H_4SO_3H$ and then neutralising this with sodium alkali. Both tetramer and hexamer can react with phenol to give respectively $C_8F_{15}OC_6H_5$ and $C_{12}F_{23}OC_6H_5$ from which the sulphonic acids and their sodium salts can be made in a similar manner. The corresponding potassium and lithium, ammonium or tetraalkyl ammonium salts can be made by the same or a similar route. The acids or the corresponding acid chlorides may be reacted with suitable diamines e.g. aliphatic diamines containing 1-6 carbon atoms, to form an amide link at one end of the diamine, the free amine being subsequently quaternised to form a cationic centre. For example compounds having the formula $C_{2n}F_{4n-1}0.0_6H_4SO_2NH(CH_2)_mN^+(XYZ)$ $A^-$ may be made from oligomer oxybenzene sulphonic acid chlorides and aliphatic amines. In such compounds n may be 4, 5 or 6

*m* may be from 1 to 6, preferably 3

X, Y and Z may be the same or different and represent alkyl groups, preferably methyl or ethyl groups and A is any anion preferably an anion derived from a quaternisation reaction.

The quaternisation reaction may be conducted with an alkyl halide preferably an alkyl bromide or iodide or an alkyl sulphate preferably dimethyl sulphate. Anions may be exchanged subsequently if desired, and therefore the surface-active agents used may contain any anion which allows adequate solubility in water.

Examples of surface active compounds for use as foaming agents which may be made from the appropriate oligomer/oxybenzene sulphonic acids or acid chlorides are $C_8F_{15}OC_6H_4So_3^-Na^+$ derived from the tetramer $C_8F_{16}$ $C_{10}F_{19}OC_6H_4SO_3$ $NH_4$ $^+$ derived from the pentamer $C_{10}F_{20}$ $C_{10}F_{19}OC_6H_4SO_2NH(CH_2)_3$ $N^+$ $(CH_3)_3I^-$ derived from the pentamer $C_{10}F_{20}$ $C_{12}F_{23}OC_6H_4SO_3^-$ $_N{}^+{}_{(C2}H_5)_4$ derived from the hexamer $C_{12}H_{24}$ The reaction of oligomers with the methyl esters of sodium p-hydroxy bencoic acid and the hydrolysis of the product to give oligomer oxybenzoic acid is also described in U.K. Pat. No. 1,130,822. From such oxybenzoic acid derivatives of tetramer, pentamer or hexamer, a range of surface-active agents may be made, for example salts having the formula $C_{2n}F_{4n-1}OC_6H_4COO^-M^+$ where n is 4, 5 or 6. M may be an alkali metal, preferably sodium, potassium or lithium, the ammonium group, tetraalkyl ammonium, preferably tetramethyl or tetraethyl ammonium, or any other basic group capable of forming salts with benzoic acids for example an aliphatic amino group or a pyridinium group.

Other surface-active agents may be prepared from the oligomer oxybenzoic acids by reaction of the carboxylic acid (or optionally the acid chloride) with molecules having an N-H group, preferably a primary or secondary amino group. Thus oligomer oxybenzamide derivatives may be made and if the molecules so added contain hydrophilic groups, for example carboxylic acid or salts thereof, in addition to the N-H group surface-active compounds are made without further reaction. For example compounds may be made from amino acids having the formula $C_{2n}F_{4n-1}OC_6H_4CO—N(L)—COO^-M^+$ in which L is an alkyl group and M may be a hydrogen atom, an alkali metal atom an ammonium group or tetraalkyl ammonium group.

Alternatively hydrophilic groups may be attached by subsequent reactions, for example by quaternisation of the free amino group when an aliphatic diamine is used, to make compounds of general formula $$C_{2n}F_{4n-1}OC_6H_4CONH(CH_2)_mN^+(XYZ)\ A^-$$

in which

*m* may be a small integer preferably from 1 to 6,

X, Y and Z which may be the same or different are alkyl groups preferably methyl or ethyl and $A^-$ may be any anion obtained from the quaternisation reaction as hereinbefore specified.

The free amino group of a diamine may be converted to an ampholytic group by reaction with a beta-lactone preferably beta-propiolactone whereby compounds of formula $C_{2n}F_{4n-1}OC_6H_4CONH(CH_2)_mN^-(XY)CH_2CH_2COO^-$ or $C_{2n}F_{4n-1}OC_6H_4SO_2NH(CH_2)_mN^+(XY)CH_2CH_2COO^-$ may be made, wherein n and m are as hereinbefore specified and Xy may be alkyl groups preferably methyl or ethyl.

The oxybenzene derivative may be itself a basic group for example the group $—OC_6H_4CH_2NXY$ (in which X, Y may be hydrogen or alkyl) and it may be attached to the oligomer residue by similar reactions to those described hereinbefore. Hydrophilic groups may be attached at the basic end by quaternisation of the —NXY group or by reaction with a lactone to form compounds of formula $C_{2n}F_{4n-1}OC_6H_4CH_2N^+(XYZ)$ $A^-$ or $C_{2n}F_{4n-1}OC_6H_4CH_2N^+(XY)CH_2CH_2COO^-$ wherein n, X, Y, Z and A are as hereinbefore specified. Examples of compounds which are used as surface-active agents produced from the tetrafluoroethylene pentamer by the reactions described are $C_{10}F_{19}OC_6H_4CONH(CH_2)_3$ $N^+(CH_3)_3$ $I^-$ $C_{10}F_{19}OC_6H_4CONH(CH_2)_3N^+(CH_3)_2CH_2CH_2COO^-$ $C_{10}F_{19}OC_6H_4CON(CH_3)CH_2COO^-K^+$ $C_{10}F_{19}OC_6H_4CH_2N^+(C_2H_5)_3$ $Br^+$ Analogous compounds may in all cases be formed from the tetramer or the hexamer of tetrafluoroethylene if desired.

In U.K. Pat. No. 1,148,486 there are described reactions between tetrafluoroethylene oligomers and amines which eliminate HF to form compounds of formula $C_{2n}F_{4n-1}NXY$ in which X and Y may be the same or different and are hydrogen, alkyl or aryl groups. Once a basic derivative of the oligomer has been formed surface-active compounds may be made by similar reactions to those hereinbefore described for the oligomer phenol derivatives which terminated in a basic nitrogen-containing group.

Compounds of general formula $C_{2n}F_{4n-1}R$ may be made in which R is a hydrophilic group made from a diamine as described above or from a glycol by an analogous reaction.

The diamine may be for example an aliphatic diamine $NH_2(CH_2)_mNXY$ which may be converted to hydrophilic groups of formula $—NH(CH_2)_mN^+(XYZ)A^+$ or $—NH(CH_2)_mN^+(XY)CH_2CH_2COO^-$ in which $m$ is from 1 to 6.

XYZ may be the same or different and may be chosen from hydrogen or alkyl, preferably methyl or ethyl groups.

A is an anion obtained from the quaternisation reaction preferably bromide or iodide.

If a glycol is attached to the oligomer the hydrophilic nature of the group R may be obtained for example by condensation of ethylene glycol or polyethylene glycol. Thereby surface-active agents from the tetramer, pentamer, and hexamer having the formula $C_{2n}F_{4n-1}O(CH_2CH_2O)_z—T$ may be made where $z$ is the degree of polymerization of the ethylene glycol preferably an integer from 1 to 20 and T is a terminal group preferably methyl or hydroxyl.

The reactions between pentamer and alkali metal sulphites or bisulphites described in U.K. Pat. No. 1,555,607 may be employed to produce surface-active derivatives of tetrafluoroethylene pentamer, having the general formula $C_9HF_{16}.SO_3R$.

The group R may be hydrogen, a metal for example an alkali metal, or a nitrogen containing ion for example ammonium or tetraalkyl ammonium. The structure of the fluorocarbon chain appears to be of the form $(C_2F_5)_2(CF_3)C.CH=C(CF_3)$ wherein one unsaturated carbon atom carries a hydrogen atom rather than a fluorine atom or a fluorinated alkyl radical.

Examples of surface-active agents which may be used to produce foams are $C_9HF_{16}SO_3^-NA^+$
$C_9HF_{16}SO_3^-K^+$
$C_9HF_{16}SO_3^-Li^+$
$C_9HF_{16}SO_3^-(NH_4)^+$
$C_9HF_{16}SO_3^-[N^+(C_2H_5)_4]$ The sulphonic acid $C_9HF_{16}SO_3H$ may be used as an intermediate to prepare other surface-active compounds by methods similar to those described for oxybenzene sulphonic acid. For example sulphonamide derivatives may be prepared having the formula $C_9HF_{16}SO_2NR^1R^2$ when $R^1$ may be hydrogen or an alkyl group preferably methyl or ethyl and $R^2$ is a hydrophilic group formed for example by quaternisation of a nitrogen atom, neutralisation with alkali of a carboxylic or sulphonic acid or by polymerisation of ethylene glycol.

Examples of compounds which may be prepared include the compounds $C_9HF_{16}SO_2NH(CH_2)_3N^+(CH_3)_3I^-$
$C_9HF_{16}SO_2N(C_2H_5)CH_2COO^-K^+$ A reaction of pentamer with alkalis described in U.K. Pat. No. 1,155,607 may be used to produce surface-active agents having the formula $C_6F_{13}CH_2CO — Q$, wherein Q is hydrophilic group. In these compounds the structure of the $C_6F_{13}$ group is believed to be

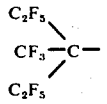

The surface-active agent may, for example, a carboxylic acid (when Q is a hydroxyl group), a salt of carboxylic acid (for example a sodium or potassium salt, an ammonium salt or a quaternary ammonium salt), an amide (when Q is an amino group) or an N-substituted amide. Alternatively, Q may be an esterifying group containing a hydrophilic unit for example a polyoxymethylene chain, a polyoxyethylene chain or an alkyl group containing a cationic or anionic center.

Examples of compounds derived from $C_6F_{13}CH_2.COOH$ which may be used to produce foams include:

$C_6F_{13}CH_2COO^-Na^+$ or $C_6F_{13}CH_2COO^-K^+$
$C_6F_{13}CH_2—COO—(CH_2CH_2O)_6CH_2CH_2OCH_3$
$C_6F_{13}CH_2CONH(CH_2)_3N^+(CH_3)_2CH_2CH_2COO^-$ and compounds having formula $C_6F_{13}CH_2CONH(CH_2)_mN^+(XYZ)A^-$ where $m$ is an integer from 1 to 6 preferably equal to 3
XYZ are alkyl groups which may be the same or different and are preferably methyl or ethyl
$A^-$ is an anion derived from a quaternisation reaction and compounds having the formula $C_6F_{13}CH_2COOCH_2CH_2N^+(C_2H_5)_2LA^-$ which may be obtained by the quaternisation of $C_6F_{13}CH_2COOCH_2CH_2N(C_2H_5)_2$ in which L is an alkyl group preferably methyl or ethyl and A is a group capable of becoming an anion preferably bromide, iodide or alkyl sulphate.

In preparing the aqueous foams from any of the foregoing oligomer derivatives surface-active agents can be used individually or as mixtures. Mixtures are often useful for achieving maximum desired foam properties. Foam improvers can, if desired, be included in the solutions of surface-active agents, for example cellulose ethers, alkali carboxymethyl celluloses, polyalkylene oxides, polyalkylene glycols, hydrolysed proteins, solubilised glues and synthetic non-fluoro chemical surface-active agents and foam boosters. In the use of foams against fires a concentrated solution of the surface-active agents and foam improvers is often diluted at the site of the fire using any convenient water supply available. Any of the foamable compositions disclosed herein may be diluted with any natural water including sea water.

In preparing foams the oligomer-based surface-active agents are conveniently used in aqueous solutions at concentrations of 0.10% to 5% by weight, preferably 0.25% to 1.0% of the composition immediately prior to foaming. A convenient concentration of foam improver is 0.05% to 1.0% by weight of the composition prior to foaming. To generate the foam the solution may be blown with a non-inflammable gas, for example nitrogen or a fluorocarbon propellant, or merely agitated for example by a rotary propeller or whisk. The invention is not restricted to these ranges because concentrated solutions are often prepared.

In compositions where the oligomer-based surface-active agent is present together with a further agent for producing a fire-fighting foam the other agent may be for example derived from a protein, a modified protein, a hydrophilic macromolecular compound (optionally based upon cellulose) or a synthetic surface-active agent. The further foaming agent when derived from a protein may contain for example glues, stabilised derivatives of albumins or globulins, or hydrolysed derivatives of protein containing materials such as blood, soya bean, or keratin. The further foaming agent when derived mainly from synthetic materials may include for example soaps, ammonium or sodium lauryl sulphate, ammonium or sodium lauryl ether sulphates, alkyl benzene sulphonates, alkyl naphthalene sulphonates and may be fire-fighting formulations based on any of these materials.

Foams made from many of the macromolecular compounds hereinbefore described, for example protein derivatives, are often relatively stiff but they can be rendered more mobile by the presence of another surface-active agent, and if the other surface-active agent is a compound based upon oligomers of tetrafluoro ethylene as exemplified herein the fire-fighting properties of the foams are improved.

The foaming agent not derived from branched oligomers of tetrafluoroethylene is often used for fire-fighting purposes at a concentration in water of between 0.1% to 6.0% by weight usually at between 0.5% and 2.5% by weight of the foaming ingredient when that agent is based on a protein.

Surface-active agents based upon tetrafluoroethylene oligomers according to this invention may be added to the aqueous solution prior to foaming at a concentration of between 0.001% and 0.1% preferably between 0.01% and 0.03% by weight. Compositions which are concentrated forms of these solutions with or without water may be prepared ready for dilution with water prior to generating the foam.

Examples of the surface-active agents which improve the properties of non-fluorocarbon-based fire-fighting foams include the compounds $C_{10}F_{19}OC_6H_4SO_3^-Na^+$
$C_{10}F_{19}OC_6H_4CONH(CH_2)_3N^+(CH_3)_3\ ]CH_3SO_4]^-$
$C_{10}F_{19}O(CH_2CH_2O)_{11}CH_3$
$C_9HF_{16}SO_3^-Na^+$
$C_9HF_{16}SO_3^-NH_4^+$
$C_6F_{13}CH_2COO^-\ Na^+$
$C_6F_{13}CH_2COO^-NH_4^+$ When the non-fluorocarbon-based foaming agent is derived from a protein or a modified protein the surface-active agent added preferably contains an anionic group attached to the tetrafluoroethylene oligomer residue, for example an anionic group such as $C_{10}F_{19}OC_6H_4SO_3^-$
$C_9HF_{16}SO_3^-$
$C_6F_{13}CH_2SOO^-$ or $C_6F_{13}OC_6H_4CON(CH_3)CH_2COO^-$ In the foamable compositions comprising an oligomer-based surface-active agent and a further agent conventionally employed in making fire-fighting foams, that further agent may contain a fluorocarbon chain not derived from branched tetrafluoroethylene oligomers. These fluorochemical agents are usually derived from compounds containing straight-chain or substantially straight-chain perfluoroalkyl groups of 4—12 carbon atoms in length for example $n\text{-}C_7F_{15}CONH(CH_2)_3N^+(CH_3)_3I^-$
$n\text{-}C_7F_{15}CONH(CH_2)_3N^+(CH_3)_2CH_2CH_2COO^-$ derived from perfluorooctanoic acid, $n\text{-}C_7F_{15}COOH$, and $n\text{-}C_8F_{17}SO_2NH(CH_2)_3N^+(CH_3)_3I^-$
$n\text{-}C_8F_{17}SO_2N(C_2H_5)CH_2COO^-K^+$ derived from perfluoro-n-octanesulphonic acid $n\text{-}C_8F_{17}SO_3H$ and $(CH_3)_2CF\text{-}\ (CF_2)_5COO^-[NH_4^+]$and $CF_3CF(CF_2)_5COO^-NH_4^+$ derived from ω-trifluoromethyl perfluoro-n-octanoic acid.

The total concentration of fluorochemical surface-active agents in the aqueous composition that is to be foamed is suitably from 0.1% to 5% by weight preferably 0.25% to 1.0% but concentrated solutions up to 50% may be prepared suitable for dilution. The weight ratio in the mixture of those agents whose molecules are derived from tetrafluoroethylene oligomers to those agents whose molecules have fluoroalkyl groups not derived from branched tetrafluoroethylene oligomers is from 100:1 to 1:1 preferably from 20:1 to 5:3.

The foams containing surface-active agents derived from branched tetrafluoroethylene oligomers described herein are observed to possess improved properties valuable for fire-fighting purposes. In addition to the improvements in the mobility of the foam imparted by the oligomer-based surface-active agent, striking improvements in the ability of the foam to resist flames has been observed. Also the foaming power of many foaming agents used in fire-fighting is severely impaired by the presence of petrol or other hydrocarbon fuel particularly hot or burning petrol. The foams and foamable compositions of this invention possess particularly good petrol tolerance and therefore show greatly improved fire-fighting performance against petrol fires compared with other foams which do not contain any fluorochemical.

The foams and foamable compositions disclosed herein are also compatible with dry chemical fire-extinguishing agents for example fire-extinguishing compositions which include sodium bicarbonate, potassium bicarbonate, ammonium phosphate, potassium chloride, potassium sulphate or the fire-extinguishing compositions which are the subject of U.K. Pat. No. 1,168,092 (corresponding with U.S. Pat. No. 3,536,620).

The dry powder extinguishing agents often do not prevent reignition of hot solids in a fire and the foams of this invention may be applied to blanket the hot solids and prevent possible reignition. Thus foams containing tetrafluoroethylene oligomer-based surface-active agents, either as main constituent or as a secondary modifying constituent to other foams, form a useful supplementary fire-fighting system to the attack with dry powder extinguishing agents.

The invention is illustrated but not limited by the following examples in which the parts and percentages are by weight unless otherwise stated.

EXAMPLES

The evaluation of surface-active agents derived from tetrafluoroethylene oligomers for use as, or additives to, fire-fighting foams was conducted by assessing the following five properties of the test foam:

i foaming power and foam stability
ii ability to resist flames
iii mobility of foam and re-seal properties
iv tolerance to petrol
v compatibility with finely-divided fire-extinguishing dry powders.

a. The foaming power and foam stability were evaluated by measuring the "quarter drainage time" (the time in seconds required for 25% of the original liquid content of a foam, made by foaming 100 ml of solution to an expansion of 8 times, to drain away and collect as liquid at the base of the foam).

b. Ability to resist flames was measured by determining "burnback time," (the time in seconds required for a given volume of foam exposed to a petrol flame to break down or disappear). The apparatus for measuring the "burnback time" consists of an 8-inch diameter circular brass dish 2 inches deep divided into two equal compartments by a vertical partition located along a diameter. The upper edge of the partition is in the same plane as the rim of the dish but its lower edge terminates 1/8th-inch above the bottom of the dish. 500 ml petrol are poured into the dish and one compartment is then filled evenly with a layer of foam on the petrol up to the rim. The petrol in the other compartment is set alight; one thus has a fixed volume of foam exposed to an approximately constant source of heat. The time taken for the foam to disappear completely and the petrol to burn freely in both compartments is the "burnback time."

c. The mobility of the foams was assessed by visual observation, and also by comparing the shear strength of foams prepared under identical conditions.

d. The tolerance to petrol was assessed partly by observing performance in the "burnback" test, when an improved "burnback time" indicated an improved tolerance to heat and hot fuel. See also test (f) below.

e. Compatibility of foams generated from fluorochemicals alone, with finely-divided fire-extinguishing powders is measured empirically by sprinkling 3 g. of sodium bicarbonate surface-treated with compounds known to the art, for example stearates, palmitates and silicones, on to 36 sq. inches of foam and observing whether or not the foam collapses. See also test (g).

f. The petrol tolerance was also measured by the following test.

The foam was injected into the base of a column of petrol 6 inches to 12 inches in height and passed through the petrol in a turbulent manner picking up petrol as it ascended. The foam arriving at the surface of the petrol contained some petrol at a concentration depending on the height of column through which the foam had risen. The contaminated foam was collected and divided into two portions.

i. One portion was poured into a 4-inch diameter steel pan, and a flame was held near the surface of the foam and the burning characteristics noted.

ii. The other portion was frozen, powdered in a mortar, and allowed to warm up, the petrol and water phases separated, and the % petrol measured.

350 cc of a motor grade petrol were placed in an open-top steel pan having dimensions 10-inch × 5-inch × 2-inch deep containing a vertical gauze screen located 1-inch from one side of the pan and extending from the base of the pan vertically. The partition was made of 16 mesh steel gauze.

The foam for test was poured into the large compartment, 10g of a fire-extinguishing powder were then sifted on to the foam surface. The petrol was ignited and the time for complete foam destruction was recorded as the "burnback time." The procedure was repeated but no powder was added and the time measured again for complete foam destruction.

h. A U.K. Ministry of Defence Test (Specification DEP 1420) was also used to demonstrate the general fire-fighting efficiency of foams.

8 oz. of powder are distributed over the surface of 5 gallons of petrol contained in a tray 3-ft diameter and 4-inch deep. The petrol is ignited and allowed to burn for 60 seconds before application of the foam at a rate of 0.35 gallon liquid per minute (0.05 gal/sq.ft./min). The foam of expansion ratio 8 is produced from a 3% solution of protein concentrate (equivalent to 1% protein). It is discharged from a 9/32-inch diameter nozzle placed 8-ft from the centre of the fire, and is directed to fall into the centre of the tray. Three radiometers are placed round the fire to measure the radiation intensity. The fire is considered to be controlled when its intensity is reduced to 10% of the value shown at the end of the 60-second preburn.

j. Re-sealing properties in the presence of oligomer-based surfactant were demonstrated by the following test.

At the conclusion of the test outlined above, a small area of fuel (approx. 6-inch × 6-inch) was exposed by opening the foam blanket. The fuel was reignited, and the foam blanket spread across the exposed fuel extinguishing the flames. This did not occur in the absence of the oligomer-based surfactant.

EXAMPLE 1

Several surface-active agents derived from tetrafluoroethylene oligomers were prepared as 0.25% by weight aqueous solutions and results obtained for fire-fighting properties as shown in Table 1. Hydroxypropyl cellulose was added to some of the solutions as detailed in Table 1 at a concentration of 0.05% by weight.

Table 1

| Surface-active Agent | Foam Improver | Test (a) Quarter Drainage Time in seconds | Test (b) Burnback Time in seconds | Test (e) Compatibility |
|---|---|---|---|---|
| $C_8F_{15}OC_6H_4SO_3^-Na^+$ | Yes | 660 | 435 | Good |
| $C_{10}F_{19}OC_6H_4SO_3^-Na^+$ | Yes | 420 | 390 | Good |
| $C_{10}F_{19}OC_6H_4SO_3^-Na^+$ | No | 132 | 210 | Good |
| $C_{10}F_{19}OC_6H_4CONH(CH_2)_3N^+(CH_3)_3I^-$ | Yes | 180 | 380 | V. Good |
| $C_{10}F_{19}OC_6H_4CONH(CH_2)_3N^+(CH_3)_2CH_2CH_2COO^-$ | Yes | 162 | 180 | Good |
| $C_{10}F_{19}OC_6H_4CON(CH_3)CH_2COO^-K^+$ | Yes | 120 | 280 | Good |
| $C_{10}F_{19}OC_6H_4SO_2NH(CH_2)_3N^+(CH_3)_3I^-$ | Yes | 120 | 210 | Good |
| $C_{10}F_{19}HN(CH_2)_3N^+(CH_3)_3I^-$ | No | 120 | 195 | Good |
| $C_{10}F_{19}OC_6H_4CH_2N^+(CH_3)_3Br^-$ | Yes | 120 | 210 | Good |

g. Ability to resist flames with and without dry powder extinguishing agents was assessed by measuring the time for the foam to be destroyed in the following manner, referred to as the "Indoor Powder Compatibility Test."

EXAMPLE 2

Tables 2 and 3 show the results of fire-fighting evaluation tests for surface active agents added to a 2% protein foam. The concentration of fluorine compound was 0.02% by weight.

Table 2

| Foam Solution | Fluorochemical Surfactant | Test (a) Quarter Drainage Time Minutes | Test (b) Burnback time Minutes |
|---|---|---|---|
| Protein | None | 5 | 2¼ |
| " | $C_8F_{15}OC_6H_4SO_3^-Na^+$ | 9 | 3¾ |
| " | $C_{10}F_{19}OC_6H_4SO_3^-Na^+$ | 6 | 2½ |
| " | $C_{10}F_{19}OC_6H_4COO^-Na^+$ | 10 | 3 |

Table 3

| Foam | Petrol Tolerance Test (f) Petrol Pickup % | Burning Characteristics |
|---|---|---|
| 1.3% Protein alone | 10 | Burns readily, extinguished 20 secs. |
| " | 15 | Burns readily, extinguished 30 secs. |
| " | 30 | Burns readily, burnt to destruction |
| 1.3% Protein + 0.02% $C_{10}F_{19}OC_6H_4SO_3^-Na^+$ | 10 | Would not ignite |
| " | 25 | Difficult to ignite, extinguished 5 secs. |
| " | 30 | Difficult to ignite, extinguished 15 secs. |

Table 4

| Foam | Indoor Powder Compatibility Test (g) Time for Complete Destruction (mins) Control (no powder) | With $NaHCO_3$-fire-fighting powder |
|---|---|---|
| 1.3% Protein alone | 3.5 | 1.5 |
| "+0.02% $C_8F_{15}OC_6H_4SO_3^-Na^+$ | 10.0 | 9.25 |
| "+0.02% $C_{10}F_{19}OC_6H_4SO_3^-Na^+$ | 10.75 | 10.0 |
| "+0.02% $C_{12}F_{23}OC_6H_4SO_3^-Na^+$ | 7.0 | 6.25 |
| "+0.02% $C_{10}F_{19}OC_6H_4COO^-Na^+$ | 7.0 | 7.0 |
| 1% Naphthalene sulphonic acid base | 1.5 | 1.25 |
| 1% Naphthalene sulphonic acid base +0.002% $C_{10}F_{19}OC_6H_4SO_3^-Na^+$ | 2.5 | 2.5 |
| 1.3% Protein alone | < ½ min. | < ½ min. |
| "+0.02% $C_{10}F_{19}OC_6H_4SO_3^-Na^+$ | 7.0 | 7.0 |
| Solutions in sea water | | |
| 1.3% Protein alone | 10.0 | 3.25 |
| "+0.02% $C_{10}F_{19}OC_6H_4SO_3^-Na^+$ | 13.5 | 13.0 |

*Petrol containing 10% industrial methylated spirits

Table 5

| Foam | General Fire-Fighting Efficiency Tests (h) and (j) Time to achieve 9/10 control (secs.) No powder | With $NaHCO_3$ fire-fighting powder |
|---|---|---|
| Protein alone | 90 | 210 |
| 1.0% Protein +0.03% $C_8F_{15}OC_6H_4SO_3^-Na^+$ | 80 | 80 |
| 1.0% Protein +0.03% $C_{10}F_{19}OC_6H_4SO_3^-Na^+$ | 70 | 75 |
| 1.0% Protein +0.02 % $C_{12}F_{23}OC_6H_4SO_3^-Na^+$ | 100 | 125 |

EXAMPLE 3

The results of fire-fighting tests on foams made from 0.25% aqueous solutions of the surface-active agent $C_9HF_{16}SO_3^-$ $Na^+$ together with a foam improver are shown in Table 6.

The effect of the same surface-active agent at a concentration of 0.02% on a 1.3% protein foam is shown in Table 7.

Table 6

| Foam Improver | Concentration 0.01% by Weight | Test (a) Quarter Drainage Time (secs) | Test (b) Burnback Time (secs) | Test (c) Powder Compatibility |
|---|---|---|---|---|
| Hydroxypropyl cellulose | | 335 | 130 | Yes |
| Polyethylene Oxide | | 280 | 150 | Yes |

Table 7

| Foam | Test (a) Quarter Drainage Time (mins) | Test (b) Burnback Time (mins) |
|---|---|---|
| Protein | 10 | 1.5 |
| Protein + $(C_2F_5)_2(CF_3)CCH = C(CF_3)SO_3^-Na^+$ | 7 | 3.0 |

Table 8

| Foam | Petrol Tolerance Test (f) Petrol Pickup % | Burning Characteristics |
|---|---|---|
| 1.3% Protein alone | 10 | Burns readily, extinguished 20 secs. |
| 1.3% Protein alone | 30 | Burns readily, burnt to destruction |
| 1.3% Protein +0.02% $(C_2H_5)_2(CF_3)CCH = C(CF_3)SO_3^-Na^+$ | 10 | Difficult to ignite, extinguished 15 secs. |

Table 8-continued

| Foam | Petrol Tolerance Test (f) Petrol Pickup % | Burning Characteristics |
|---|---|---|
| " | 30 | Difficult to ignite, extinguished 45 secs. |

Table 9

| Foam | Indoor Powder Compatibility Test (g) Time for Complete Destruction (mins) Control (no powder) | With $NaHCO_3$ fire-fighting powder |
|---|---|---|
| 1.3% Protein alone | 3.5 | 1.5 |
| 1.3% Protein +0.02% $(C_2F_5)_2(CF_3)CCH{=}C(CF_3)SO_3^-Na^+$ | 6.0 | 4.5 |

EXAMPLE 4

The results of fire-fighting tests of foams made from 0.25% aqueous solutions of surface-active agents of the general formula $C_6F_{13}CH_2CO{-}X$ are shown in Table 10. A foam improver, hydroxypropyl cellulose was included as indicated by the concentrations shown in Table 10.

Table 11

| Foam | Quarter Drainage Time (mins) | Burnback Time (mins) |
|---|---|---|
| Protein | 10 | 1.5 |
| Protein + $(C_2F_5)_2(CF_3)CCH_2COO\ Na^+$ | 7.5 | 2.0 |

Table 12

| Foam | Petrol Tolerance Test (f) Petrol Pickup % | Burning Characteristics |
|---|---|---|
| 1.3% Protein alone | 10 | Burns readily, extinguished 20 secs. |
| 1.3% Protein alone | 30 | Burns readily, burnt to destruction |
| "+0.02%$(C_2F_5)_2(CF_3)CCH_2COO\ Na^+$ | 10 | Difficult to ignite, extinguished 30 secs. |
| | 30 | Difficult to ignite, 45 secs. |

Table 13

| Foam | Indoor Powder Compatibility Test (g) Time for Complete Destruction (mins) Control (no powder) | With $NaHCO_3$ fire-fighting powder |
|---|---|---|
| 1.3% Protein alone | 3.5 | 1.5 |
| "+0.02% $(C_2F_5)_2(CF_3)CCH_2COO^-Na^+$ | 6.0 | 4.5 |

The effect of 0.02% by weight of the same surface-active agents on a 1.3% protein foam is shown in Tables 11, 12 and 13.

Table 10

| Surface-active Agent | 0.25% Aqueous Solutions Foam Improver Concentration (by wt.) | Quarter Drainage Time (secs) |
|---|---|---|
| $(C_2F_5)_2(CF_3)CCH_2COO^-Na^+$ | 0.05% | 160 |
| $(C_2F_5)_2(CF_3)CCH_2COO(CH_2CH_2O)_6CH_2CH_2OCH_3$ | 0 | 100 |
| $(C_2F_5)_2(CF_3)CCH_2CONH(CH_2)_3N^+(CH_3)_2CH_2CH_2COO^-$ | 0.25% | 50 |
| $(C_2F_5)_2(CF_3)CCH_2COCH_2CH_2N^+(C_2H_5)_2CH_3.I^-$ | 0.25% | 20 |

EXAMPLE 5

A protein solution (1.3% by weight) was foamed with and without an added concentration of 0.02% by weight of each of the surface-active agents

| |
|---|
| $C_6F_{13}CH_2COO^-Na^+$ |
| $C_9HF_{16}SO_3^-Na^+$ |
| $C_{10}F_{19}OC_6H_4S_3^-Na^+$ |
| $C_8F_{15}OC_6H_4SO_3^-Na^+$ |

and test (c) was applied to each foam separately.

The foamed protein solution without added surface-active agent gave a stiff foam with poor ability to flow. The foams prepared from the protein solution containing 0.02% by weight of the surface-active agents were less stiff and flowed more readily. The shear strength of the protein foam was approximately three times the shear strength of the protein foams containing the fluorochemical surfactants.

EXAMPLE 6

Compositions were prepared containing mixtures of the two surface-active agents one containing a straight perfluoroalkyl chain ($n\text{-}C_7F_{15}$) and one a branched perfluorocarbon chain ($C_{10}F_{19}$) as follows:

| | |
|---|---|
| (i) | 90% of $C_{10}F_{19}OC_6H_4SO_3^-Na^+$ |
| | 10% of $n\text{-}C_7F_{15}CONH(CH_2)_3N^+(CH_3)_2CH_2CH_2COO^-$ |
| (ii) | 90% of $C_{10}F_{19}OC_6H_4CONH(CH_2)_3N^+(CH_3)_2CH_2CH_2COO^-$ |
| | 10% of $n\text{-}C_7F_{15}CONH(CH_2)_3N^+(CH_3)_3I^-$ |

all percentages by weight.

Both mixtures had good compatibility with finely-divided sodium bicarbonate treated with known free-flowing agents, for example silicones or stearates. Quarter drainage times (a) and burnback times (b) were measured for aqueous solutions containing 0.02% by weight of the mixture and 0.05% by weight of a hydroxypropylcellulose as foam improver. The results are presented in Table 14.

Table 14

| Surface-active Agent | Test (a) Quarter Drainage Time (secs) | Test (b) Burnback Time (secs) (secs) |
|---|---|---|
| Composition (i) | 840 | 450 |
| Composition (ii) | 120 | 195 |
| $n\text{-}C_7F_{15}CONH(CH_2)_3N(CH_{32}CH_2CH_2COO^-$ | 240 | 225 |
| $C_{10}F_{19}OC_6H_4SO_3^{-Na+}$ | 420 | 390 |

What we claim is:

1. A method of fighting fires which comprises applying to the fire a foam produced from an aqueous composition comprising as a surface-active agent the residue of a branched oligomer of tetrafluoroethylene $(C_2F_4)_n$ wherein $n$ is 4, 5, or 6 having a hydrophilic group attached to the residue of the oligomer, said oligomer having at least three $CF_3$ groups and being characterized by a formula selected from the group consisting of:

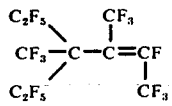

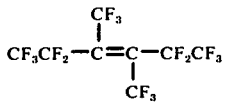

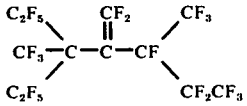

and

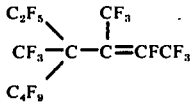

2. A method as claimed in claim 1 wherein the agent is a sulphonic acid or salt thereof, a sulphonamide, a carboxylic acid or derivative thereof.

* * * * *